US007735204B2

(12) United States Patent
Hoover

(10) Patent No.: US 7,735,204 B2
(45) Date of Patent: Jun. 15, 2010

(54) TEXTILE PROCESSING ASSEMBLY, STUFFER BOX, AND METHOD FOR TEXTURING YARN

(75) Inventor: Donald Lynn Hoover, Clover, SC (US)

(73) Assignee: American Linc Corporation, Gastonia, NC (US)

( * ) Notice: Subject to any disclaimer, the term of this patent is extended or adjusted under 35 U.S.C. 154(b) by 603 days.

(21) Appl. No.: 11/811,595

(22) Filed: Jun. 11, 2007

(65) Prior Publication Data

US 2008/0301922 A1 Dec. 11, 2008

(51) Int. Cl.
*D02G 1/12* (2006.01)

(52) U.S. Cl. ..... 28/263; 28/264; 28/266

(58) Field of Classification Search ..... 28/263, 28/264, 266, 265, 267–269, 221, 247, 250, 28/281, 254; 264/168
See application file for complete search history.

(56) References Cited

U.S. PATENT DOCUMENTS 1,751,471 A * 3/1930 Campbell ..... 162/280
2,917,784 A * 12/1959 Spence et al. ..... 28/264
3,037,260 A * 6/1962 Pike, Jr. ..... 28/250
3,345,719 A * 10/1967 Gemeinhardt et al. ..... 28/251
3,406,436 A * 10/1968 Clarke, Jr. ..... 28/250
3,526,023 A * 9/1970 Mertens ..... 28/248
3,680,181 A * 8/1972 Heijnis ..... 28/269
4,041,584 A * 8/1977 Williamson ..... 28/269
4,163,306 A * 8/1979 Turner ..... 28/254
5,025,538 A * 6/1991 Saleh ..... 28/263
5,074,016 A * 12/1991 Meyer ..... 28/263
5,414,987 A 5/1995 Knoff et al.
5,647,109 A 7/1997 Steiner et al.
5,794,428 A 8/1998 Rhodes et al.
6,134,758 A 10/2000 Raskin et al.
6,302,308 B1 10/2001 Hoover et al.
6,385,827 B1 * 5/2002 Stewart et al. ..... 28/263
6,481,072 B1 11/2002 Hoover et al.
7,325,284 B2 * 2/2008 Lane et al. ..... 28/269

* cited by examiner

*Primary Examiner*—Amy B Vanatta
(74) *Attorney, Agent, or Firm*—Schwartz Law Firm, P.C.

(57) ABSTRACT

A textile stuffer box includes a housing having an entrance and an exit, and including cooperating chamber-forming surfaces defining an internal crimping chamber for receiving and accumulating a length of yarn. An adjustable sliding gate defines at least one of the chamber-forming surfaces adjacent the exit of the housing. A set screw releasably locks a position of the gate to selectively enlarge and narrow the exit of the housing, such that selective adjustment of the gate operates to control axial compression of yarn accumulating inside of the crimping chamber.

20 Claims, 7 Drawing Sheets

TEXTILE PROCESSING ASSEMBLY, STUFFER BOX, AND METHOD FOR TEXTURING YARN

TECHNICAL FIELD AND BACKGROUND

The invention in its exemplary embodiments described herein relates broadly to a textile processing assembly, stuffer box, and method for texturing yarn. Yarn textured according to embodiments of the present assembly and method may have application in various types of cut-pile carpets—namely, saxony, plush, textured and frieze. Such carpets are manufactured to achieve certain desirable and distinctive surface textures impacting hand, appearance, and wear. As such, a present need exists in the industry for a textile processing assembly, stuffer box, and method applicable to effectively manipulate yarn texture.

SUMMARY OF EXEMPLARY EMBODIMENTS

Various exemplary embodiments of the present invention are described below. Use of the term "exemplary" means by way of example only, and any reference herein to "the invention" is not intended to restrict the claimed subject matter to exact features of any one or more of the exemplary embodiments disclosed in the present specification.

According to one exemplary embodiment, a textile processing assembly is applicable for texturing and heatsetting a moving length of ply-twisted yarn. The assembly includes a pair of feed rollers, and a textile stuffer box downstream of the feed rollers. The stuffer box includes a housing having an entrance and an exit, and comprising cooperating chamber-forming surfaces defining an internal crimping chamber for receiving and accumulating the ply-twisted yarn. An adjustable sliding gate defines at least one of the chamber-forming surfaces adjacent the exit of the housing. Means are provided for releasably locking a position of the gate to selectively enlarge and narrow the exit of the housing, such that selective adjustment of the gate operates to control axial compression of yarn accumulating inside of the crimping chamber. A climate chamber is located downstream of the stuffer box, and is adapted for heat-setting the ply-twisted yarn. Means are provided for conveying the yarn downstream from the stuffer box and through the climate chamber. A take-up winder is located downstream of the climate chamber for collecting the processed yarn.

According to another exemplary embodiment, the stuffer box includes a pivoted resistance finger attached to the adjustable gate and located at the exit of the housing.

According to another exemplary embodiment, the means for releasably locking the gate comprises a locking set screw. Other alternative means may include, for example, a friction-engaging surfaces, clamps, stops, pins, springs, and the like.

According to another exemplary embodiment, the chamber-forming surfaces of the stuffer box housing include a chamber floor and chamber ceiling, and opposing chamber sides.

According to another exemplary embodiment, the chamber floor of the stuffer box housing includes a first extent adjacent the entrance of the housing and a second extent adjacent the exit of the housing, the second extent being formed at an angle to the first extent. The first and second extent of the chamber floor may define a solid, integrally-formed, continuous surface.

According to another exemplary embodiment, the chamber ceiling of the stuffer box housing includes a first extent adjacent the entrance of the housing and substantially parallel to the first extent of the chamber floor, and a second extent adjacent the exit of the housing and substantially parallel to the second extent of the chamber floor. As used herein, the term "substantially parallel" means that the opposing surfaces of the floor and ceiling have a variance of no more than 10 degrees.

According to another exemplary embodiment, the adjustable sliding gate of the stuffer box defines at least a portion of the second extent of the chamber ceiling. The second extent of the chamber ceiling increases as the sliding gate is substantially closed, and decreases as the sliding gate is opened.

According to another exemplary embodiment, the stuffer box housing includes gate-setting indicia for locating a position of the adjustable gate relative to the housing, and the adjustable gate includes an indexing element adapted to selectively align with the gate-setting indicia.

In another exemplary embodiment, the invention comprises a textile stuffer box incorporating one or more of the elements and features described above.

In yet another exemplary embodiment, the invention comprises a method for texturing yarn. The method includes feeding a moving length of yarn into an entrance of a textile stuffer box, the textile stuffer box defining an internal crimping chamber and comprising an adjustable gate. A position of the gate is slidably adjusted to selectively enlarge and narrow an exit of the stuffer box, such that selective adjustment of the gate operates to control axial compression of yarn accumulating inside of the crimping chamber.

According to another exemplary embodiment, the method includes releasably locking the adjustable gate in a selected position using a set screw.

According to another exemplary embodiment, the method includes aligning an indexing element of the adjustable gate relative to indicia located adjacent the exit of the stuffer box.

According to another exemplary embodiment, the method includes driving the moving yarn into the stuffer box using cooperating feed rollers.

As used herein, the term "yarn" refers broadly to a continuous filament or strand of fibers, such as that used in tufting, weaving, and bonding to form carpet and other fabrics. The yarn may be plied or without twist, and may be either spun staple or continuous filament.

The term "continuous filament" refers to an unbroken strand of synthetic fiber, such as filament nylon or olefin.

The term "crimp" refers to a nonlinear fiber configuration, such as a sawtooth, zigzag or random curl relative to the fiber axis. Fiber crimp generally increases bulk and cover and facilitates interlocking of staple fibers in spun yarns.

The term "textured yarn" refers to a continuous filament manufactured yarn that has been crimped—i.e., modified to create a different surface texture.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
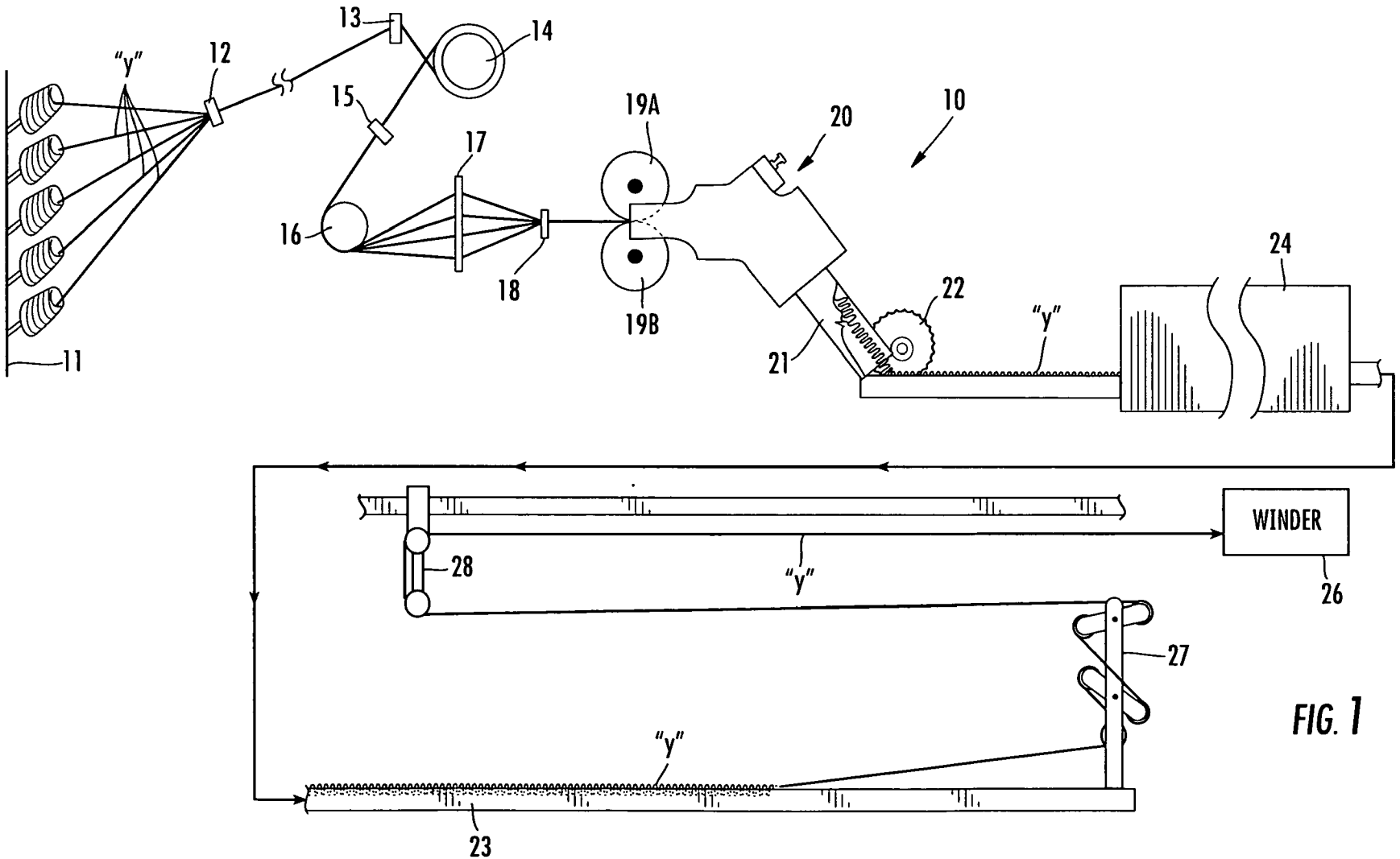
FIG. 1 is a schematic view illustrating a textile processing assembly according to one exemplary embodiment of the present invention.
Figure 2:
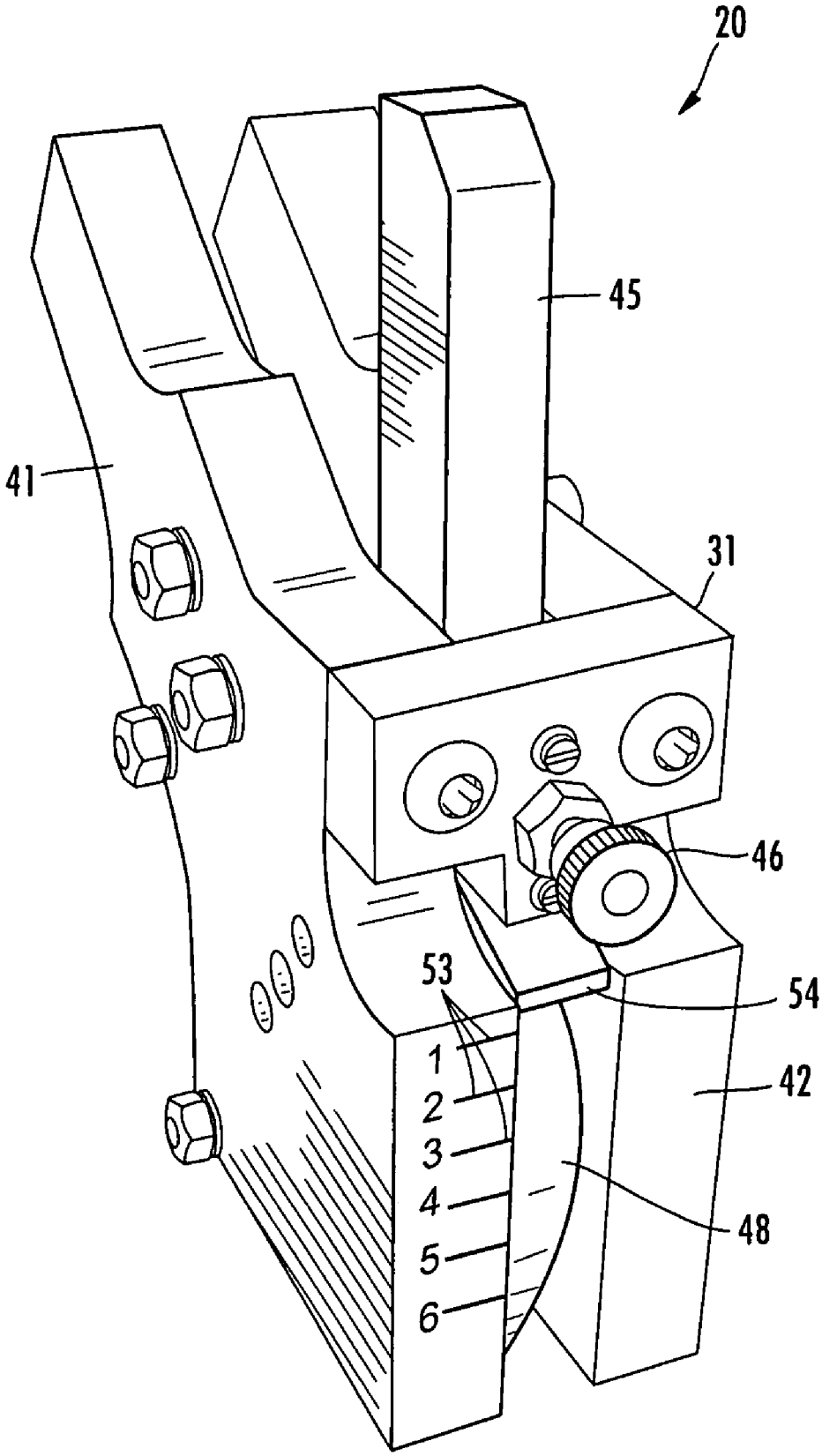
FIG. 2 is an enlarged perspective view of the textile stuffer box with the sliding gate in a relatively opened position.

Referring now specifically to the drawings, a textile processing assembly according to one exemplary embodiment of the present invention is illustrated schematically in FIG. 1, and shown generally at reference numeral 10. In one implementation, the textile processing assembly 10 is applicable for texturing and heat-setting ply-twisted multifilament yarn, such as that used in saxony, plush, textured and frieze-type carpets. The term "ply-twisted multifilament yarn" refers to a multifilament yarn constructed by cabling together two or more single yarns by, for example, a two step twisting/cabling process or a direct cabling process, both of which are commonly known to those skilled in the art. The ply-twisted yarn may have a denier in the range of about 900 to 2800, and may be composed of either bulked continuous filament (BCF) yarns or staple spun yarns, for example. The assembly 10 may also be used to process other yarns including tow.

As illustrated in FIG. 1, multiple ends of yarn "Y" are supplied from a creel 11 and moved downstream in respective continuous lengths through guides 12 and 13, around an inverter-driven overfeed roll 14, through guide 15, and over guide roll 16. The overfeed roll 14 adjusts the yarn speed for tension variations. From the overfeed, the yarn ends "Y" move to a false twister 17. The false twister 17 may comprise a bi-directionally rotating disk with multiple spaced opening for receiving respective yarn ends "Y". As commonly known and understood by those skilled in the art, the false twister 17 operates using conventional drive means (not shown) to twist and untwist the yarn strands. A further guide eye 18 is located downstream of the false twister 17, and upstream of cooperating inverter-driven feed rolls 19A and 19B. The feed rolls 19A, 19B drive the yarn ends "Y" into a textile stuffer box 20, described in detail below, where the moving yarn is axially compressed (or "crimped") to add texture. The yarn speed through the stuffer box 20 may be infinitely variable between, for example, 250 m/min and 700 m/min. The medium yarn speed for polypropylene is approximately 450 m/min, and approximately 550 m/min for polyester and nylon.

Upon exiting the stuffer box 20, the textured yarn "Y" flows down an angled chute 21 to an inverter-driven compression roll 22, and onto an inverter-driven, variable speed conveyor belt 23. The conveyor belt 23 transfers the textured yarn "Y" into and through a climate chamber 24 to heat-set the twist. The climate chamber 24 may comprise a conventional heat-setting machine, such as that known commercially as a "Superba", which treats the yarn with pressurized saturated steam. Alternatively, the climate chamber 24 may comprise a machine known commercially as a "Suessen" which treats the yarn with dry heat to heat-set the twist. The speed of the conveyor belt 23 is controlled in order to transport the textured yarn "Y" through the climate chamber 24 at a rate which yields the desired dwell time.

After heat-setting, the moving yarn "Y" accumulates downstream on the conveyor 23 for cooling, and is pulled off the belt by a winder 26. Prior to winding, the yarn "Y" undergoes a process (referred to as "shake-out") designed to separate and untangle the individual ends. From the conveyor 23, the yarn passes through a tension tower 27, and is taken back towards the climate chamber 24 by an adjustable traveling distance extender 28. The yarn "Y" extends from the distance extender 28 back to the winder 26 where it is wound on individual cones (not shown). The winder 26 may comprise, for example, an automatic doffing winder, or other suitable yarn take-up device.

In one exemplary application, the resulting textured and heat-set yarn "Y" may be tufted into the backing of a carpet. The carpet may then be dyed and subjected to other standard finishing operations including stain and soil resist treatment followed by shearing of the tufts.

Textile Stuffer Box 20

Figure 3:
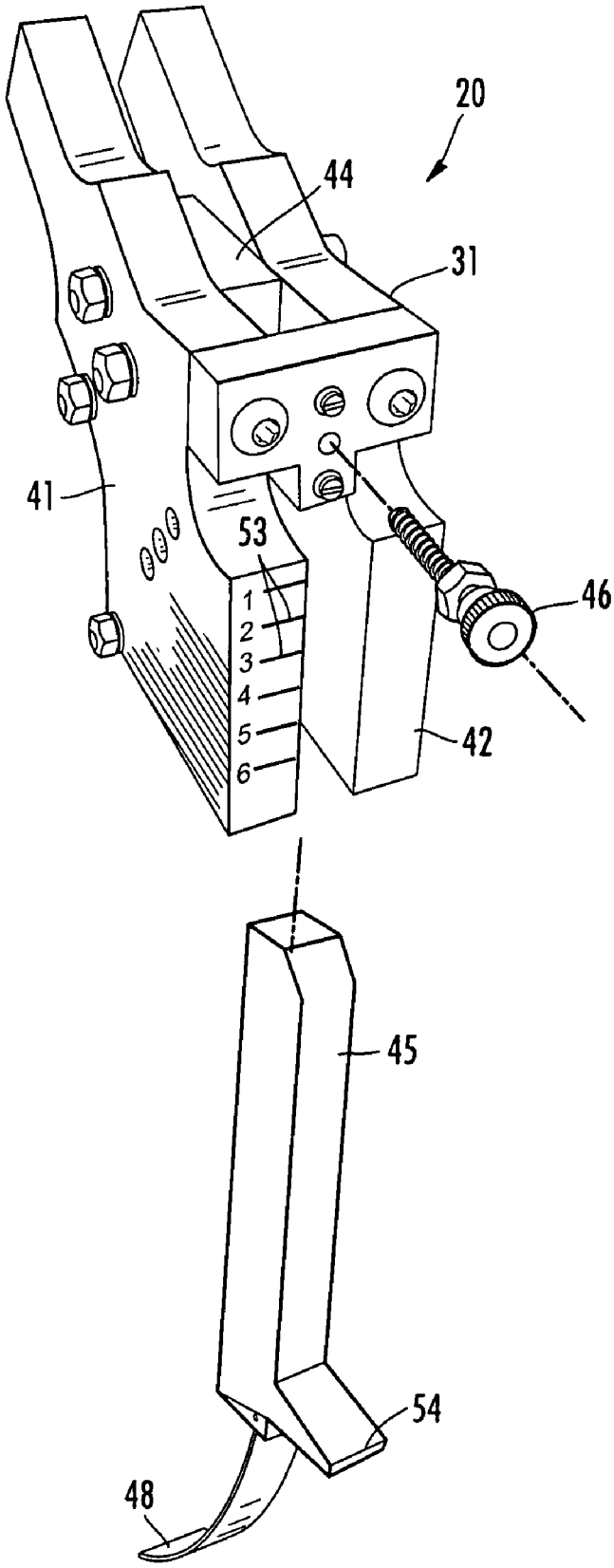
FIG. 3 is an exploded view of the textile stuffer box showing the sliding gate and locking set screw removed from the housing.
Figure 4:
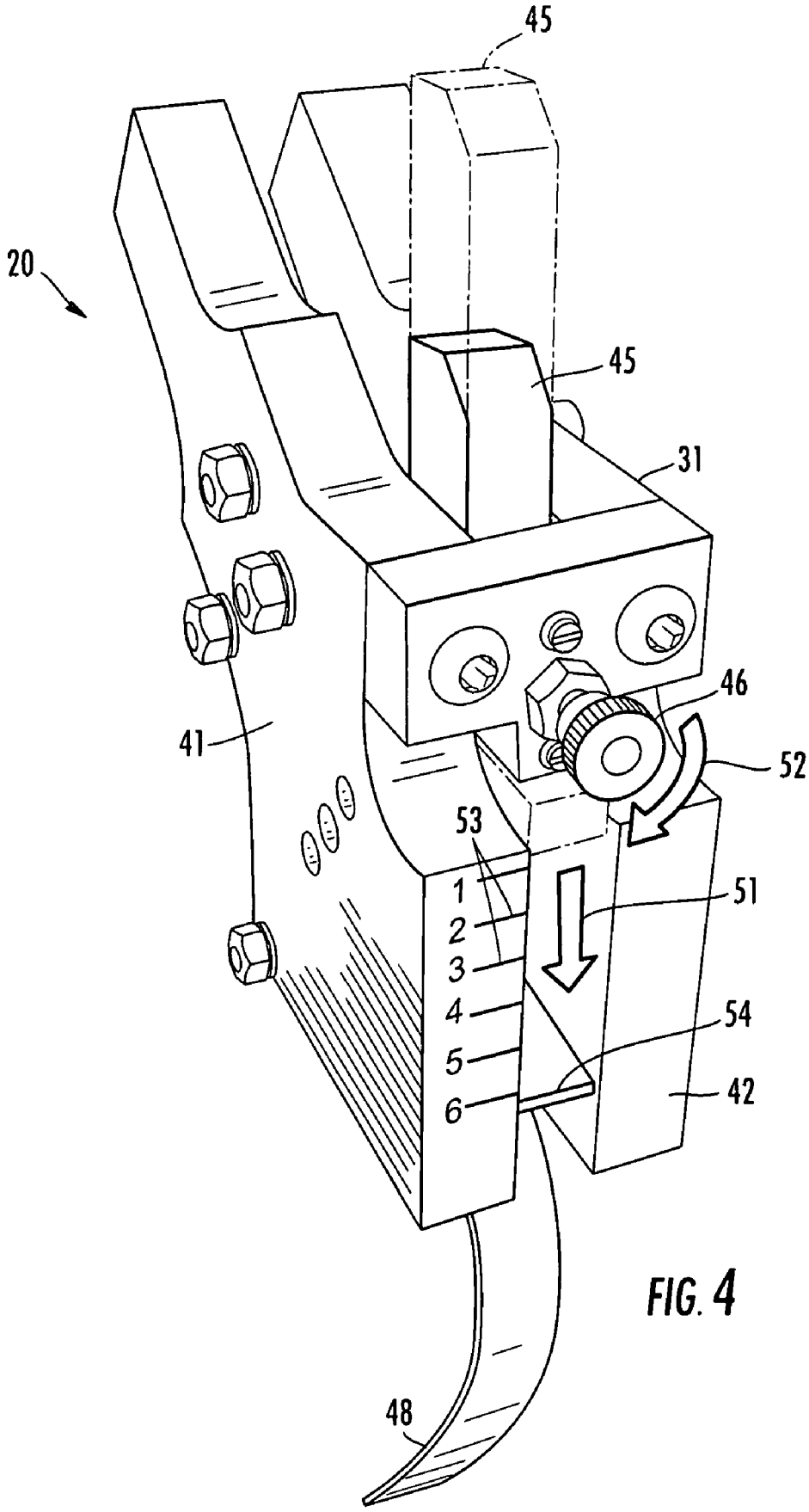
FIG. 4 is a perspective view of the textile stuffer box with the sliding gate in a relatively closed position.
Figure 5:
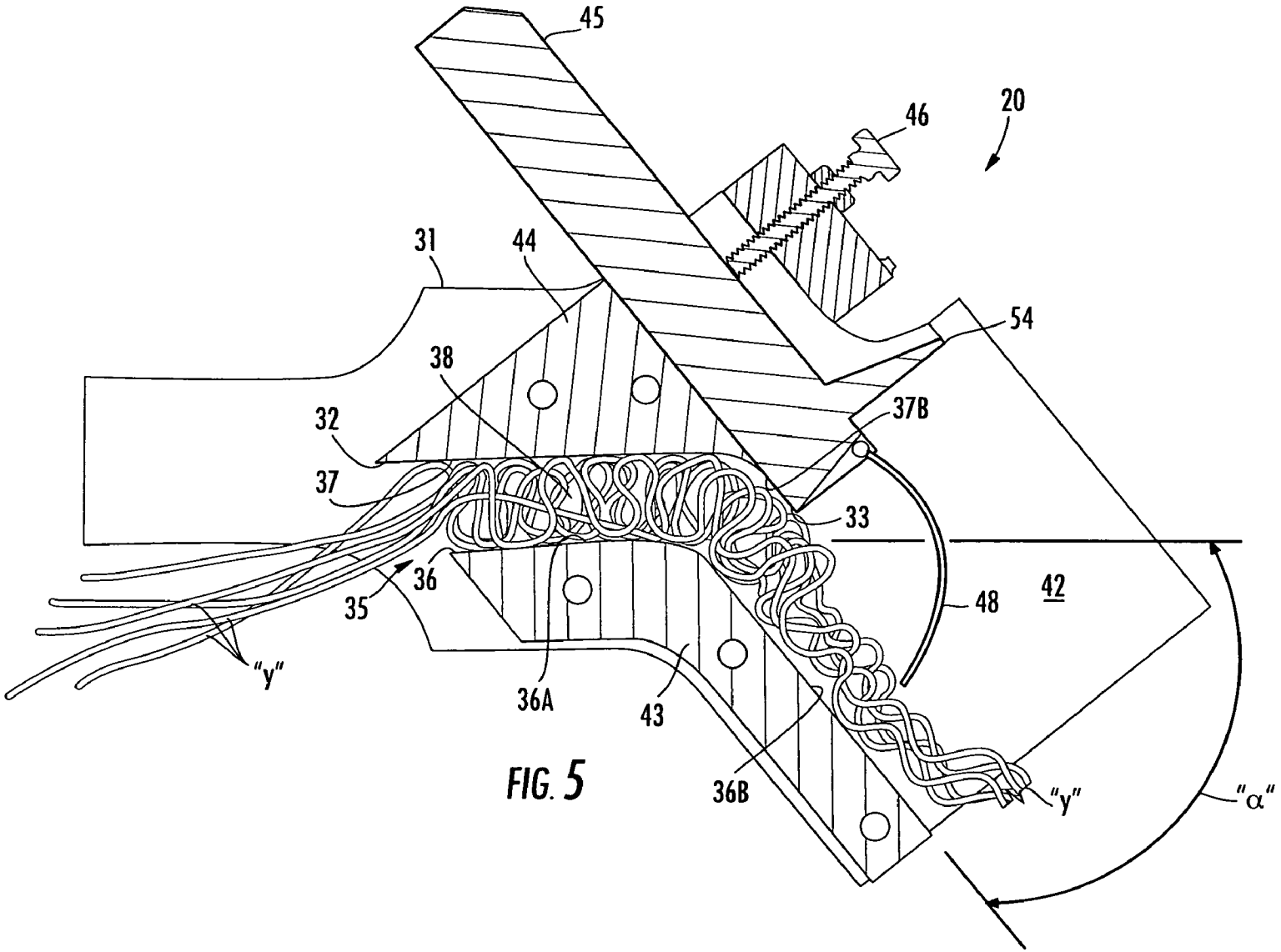
FIG. 5 is a cross-section of the textile stuffer box with the sliding gate in a relatively opened position.
Figure 6:
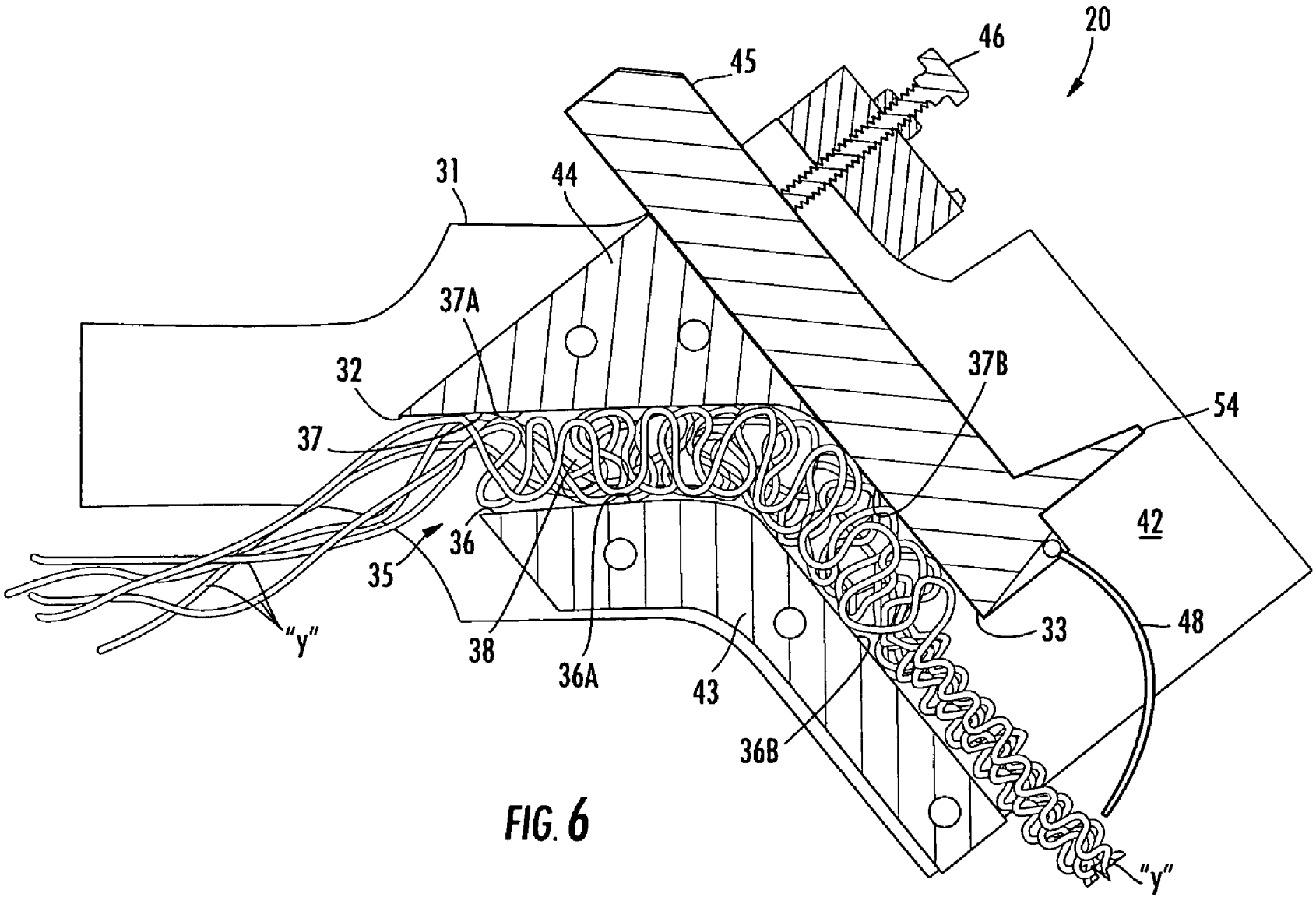
FIG. 6 is a cross-section of the textile stuffer box with sliding gate in a relatively closed position.

Referring to FIGS. 1 and 2-6, the textile stuffer box 20 is located upstream of the climate chamber 24, as previously described, and operates to texture (or crimp) the ply-twisted yarn "Y" prior to heat-setting. In the exemplary embodiment shown, the stuffer box 20 comprises a metal housing 31 having an entrance 32 and an exit 33, and cooperating chamber-forming surfaces defining an internal crimping chamber 35 for receiving and accumulating the moving length of yarn "Y". As best shown in FIGS. 5 and 6, the chamber-forming surfaces include a chamber floor 36 and chamber ceiling 37, and opposing spaced-apart chamber sides 38 (only one side shown). Each of the chamber floor 36, ceiling 37 and opposing sides 38 may be substantially flat. The chamber sides 38 are formed, respectively, by solid continuous interior surfaces of plates 41 and 42, while the chamber floor 36 is formed by a continuous interior surface of solid arcuate metal structure 43. The chamber ceiling 37 may be partly formed by a continuous interior surface of solid metal structure 44, as further described below. Respective interior surfaces of the plates 41, 42 outside of the crimping chamber 35 serve to channel textured yarn as it exits the housing and drops down chute 21 (See FIG. 1).

The chamber floor 36 comprises a first extent 36A adjacent the entrance 32 of the housing 31 and a second extent 36B adjacent the exit 33 of the housing 31; the second extent 36B being formed at an angle to the first extent 36A. The angle "α" of the second extend 36B to the first 36A may be in the range of 30-60 degrees, or 45-60 degrees, or 15-60 degrees, or 0-90 degrees. The chamber ceiling 37 has a first extent 37A adjacent the entrance 32 of the housing 31 and substantially parallel to the first extent 36A of the chamber floor 36, and a second extent 37B adjacent the exit 33 of the housing 31 and substantially parallel to the second extent 36B of the chamber floor 36. Alternatively, a crimping chamber defined one or more spans of non-parallel surfaces may yield comparable results and is contemplated herein.

As best shown in FIGS. 3, 5, and 6, an adjustable gate 45 is slidably mounted adjacent the exit 33 of the housing 31, and defines at least a portion of the second extent 37B of the chamber ceiling 37. In the embodiment shown, the gate 45 forms substantially the entire second extent 37B of the chamber ceiling 37. Using any suitable means, such as a releasably locking set screw 46, the position of the sliding gate 45 may be adjusted relative to the housing 31 to selectively enlarge and narrow the housing exit 33, thereby controlling axial compression of yarn accumulating inside of the crimping chamber 35. For example, by opening the adjustable gate 45 as shown in FIG. 5, the second extent 37B of the chamber ceiling 37 is reduced while the housing exit 33 is enlarged. In this position, the gate 45 offers less resistance to downstream movement of the yarn "Y". As a result, less yarn tends to accumulate and compress inside the crimping chamber 35. By adjusting the gate 45 to a more closed position, as shown in FIG. 6, the narrowed housing exit 33 creates added resistance to downstream movement of the yarn "Y". In this position, the second extent 37B of the chamber ceiling 37 is increased. This causes increased accumulation of yarn inside the crimping chamber 35, resulting in sharper bends and folds. Additionally, to create initial or start-up resistance in the moving yarn, a pivoted, arcuate, flat metal resistance finger 48 may extend from the gate 45 at the exit 33 of the housing 31. In other embodiments, the "start-up" resistance finger 48 may be eliminated and alternative means employed for creating initial yarn resistance.

FIG. 4 demonstrates adjustment of the sliding gate 45. With the locking set screw 46 released, the gate 45 is axially slidable as indicated at arrow 51 from a raised (or open) position, such as shown in FIG. 5, to a more closed position of FIG. 6. Once moved to the selected position, the locking set screw 46 is sufficiently rotated, as indicated at arrow 52, to engage the gate 45 and fix the position of the gate 45 relative to the housing 31. Gate-setting indicia 53 may be provided on the housing 31 and an indexing element 54 formed with adjustable gate 45 to facilitate desired placement of the gate 45. The indexing element 54 of the gate 45 may comprise an indexing edge, or other conspicuous marking. While various yarn types may react differently when textured inside the crimping chamber 35 of the stuffer box 20, it is presumed that for the same or similar type yarns, the stuffer box 20 will yield comparable texturing for yarn runs at identical gate settings. The stuffer box 20 can be operated with or without steam to influence the texture, and can generally process several ends simultaneously depending on yarn size.

Figure 7:
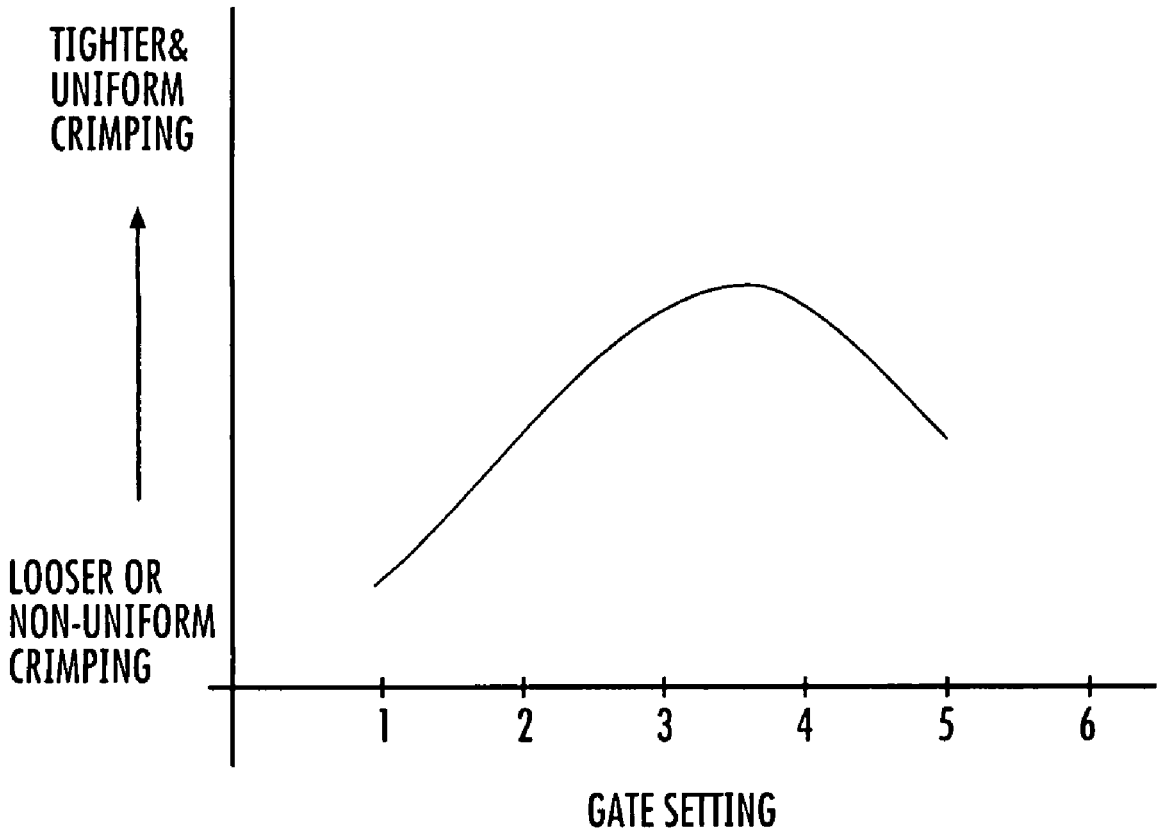
FIG. 7 is a graph indicating anticipated yarn texture verses gate setting.

While the phenomenon may not be completely understood, the graph of FIG. 7 shows what Applicant theorizes is a generally accurate representation of yarn crimp verses gate setting. As indicated, optimally tight and uniform crimping may be achieved with a generally intermediate setting of the gate 45. With a lower gate setting, crimping is generally "looser" but relatively uniform. Crimping may become inconsistently tighter and/or looser over certain lengths, and less uniform (and perhaps, less desirable) as the gate 45 closes at higher settings.

Exemplary embodiments of the present invention are described above. No element, act, or instruction used in this description should be construed as important, necessary, critical, or essential to the invention unless explicitly described as such. Although only a view of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the following claims. In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. A textile processing assembly for texturing and heatsetting a moving length of ply-twisted yarn, said assembly comprising:

(a) a pair of feed rollers adapted for engaging and moving the yarn downstream away from a supply creel;

(b) a textile stuffer box downstream of said feed rollers, and comprising:

(i) a housing having an entrance and an exit, and comprising cooperating chamber-forming surfaces defining an internal crimping chamber for receiving and accumulating the ply-twisted yarn;

(ii) an adjustable sliding gate defining at least one of said chamber-forming surfaces adjacent the exit of said housing; and (iii) means for releasably locking a position of said gate to selectively enlarge and narrow the exit of said housing, whereby selective adjustment of said gate operates to control axial compression of yarn accumulating inside of said crimping chamber;

(c) a climate chamber downstream of said stuffer box, and adapted for heat-setting the ply-twisted yarn;

(d) means for conveying the yarn downstream from said stuffer box and through said climate chamber; and (e) a take-up winder downstream of said climate chamber for collecting the processed yarn.

2. A textile processing assembly according to claim 1, wherein said stuffer box comprises a pivoted resistance finger attached to said adjustable gate and located at the exit of said housing.

3. A textile processing assembly according to claim 1, wherein said means for releasably locking said gate comprises a lock screw.

4. A textile processing assembly according to claim 1, wherein said chamber-forming surfaces of said stuffer box housing comprise a chamber floor and chamber ceiling, and opposing chamber sides.

5. A textile processing assembly according to claim 4, wherein the chamber floor of said stuffer box housing comprises a first extent adjacent the entrance of said housing and a second extent adjacent the exit of said housing, the second extent being formed at an angle to the first extent.

6. A textile processing assembly according to claim 5, wherein the chamber ceiling of said stuffer box housing comprises a first extent adjacent the entrance of said housing and substantially parallel to the first extent of the chamber floor, and a second extent adjacent the exit of said housing and substantially parallel to the second extent of the chamber floor.

7. A textile processing assembly according to claim 6, wherein said adjustable sliding gate of said stuffer box defines at least a portion of the second extent of the chamber ceiling.

8. A textile processing assembly according to claim 1, wherein said stuffer box housing comprises gate-setting indicia for locating a position of said adjustable gate relative to said housing, and wherein said adjustable gate comprises an indexing element adapted to selectively align with said gate-setting indicia.

9. A textile stuffer box for texturing yarn, comprising:

a housing having an entrance and an exit, and comprising cooperating chamber-forming surfaces defining an internal crimping chamber for receiving and accumulating a moving length of yarn;

an adjustable sliding gate defining at least one of said chamber-forming surfaces adjacent the exit of said housing; and means for releasably locking a position of said gate to selectively enlarge and narrow the exit of said housing, whereby selective adjustment of said gate operates to control axial compression of yarn accumulating inside of said crimping chamber.

10. A textile stuffer box according to claim 9, and comprising a pivoted resistance finger attached to said adjustable gate and located at the exit of said housing.

11. A textile stuffer box according to claim 9, wherein said means for releasably locking said gate comprises a lock screw.

12. A textile stuffer box according to claim 9, wherein said chamber-forming surfaces of said housing comprise a chamber floor and chamber ceiling, and opposing chamber sides.

13. A textile stuffer box according to claim 12, wherein the chamber floor comprises a first extent adjacent the entrance of said housing and a second extent adjacent the exit of said housing, the second extent being formed at an angle to the first extent.

14. A textile stuffer box according to claim 13, wherein the chamber ceiling comprises a first extent adjacent the entrance of said housing and substantially parallel to the first extent of the floor, and a second extent adjacent the exit of said housing and substantially parallel to the second extent of the floor.

15. A textile stuffer box according to claim 14, wherein said adjustable gate defines at least a portion of the second extent of the chamber ceiling.

16. A textile stuffer box according to claim 9, wherein said housing comprises gate-setting indicia for locating a position of said adjustable gate relative to said housing, and wherein said adjustable gate comprises an indexing element adapted to selectively align with said gate-setting indicia.

17. A method for texturing yarn, comprising:

feeding a moving length of yarn into an entrance of a textile stuffer box, the textile stuffer box defining an internal crimping chamber and comprising an adjustable gate;

slidably adjusting a position of the gate to selectively enlarge and narrow an exit of the stuffer box, whereby selective adjustment of the gate operates to control axial compression of yarn accumulating inside of the crimping chamber.

18. A method according to claim 17, and comprising releasably locking the adjustable gate in a selected position using a set screw.

19. A method according to claim 17, and comprising aligning an indexing element of the adjustable gate relative to indicia located adjacent the exit of the stuffer box.

20. A method according to claim 17, and comprising driving the moving yarn into the stuffer box using cooperating feed rollers.

* * * * *